US009090847B2

(12) United States Patent
Mathur et al.

(10) Patent No.: US 9,090,847 B2
(45) Date of Patent: Jul. 28, 2015

(54) LUBRICANT COMPOSITIONS CONTAINING A HETEROAROMATIC COMPOUND

(75) Inventors: Naresh Mathur, Midlothian, VA (US); Jason A. Lagona, Richmond, VA (US); John T. Loper, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 316 days.

(21) Appl. No.: 13/411,065

(22) Filed: Mar. 2, 2012

(65) Prior Publication Data

US 2012/0291737 A1 Nov. 22, 2012

Related U.S. Application Data

(60) Provisional application No. 61/488,302, filed on May 20, 2011.

(51) Int. Cl.

| | |
|---|---|
| ***C10M 133/40*** | (2006.01) |
| ***C10M 163/00*** | (2006.01) |
| ***C10M 133/56*** | (2006.01) |

(52) U.S. Cl.

CPC ..... *C10M 133/40* (2013.01); *C10M 133/56* (2013.01); *C10M 163/00* (2013.01); *C10M 2207/026* (2013.01); *C10M 2215/064* (2013.01); *C10M 2215/221* (2013.01); *C10M 2215/28* (2013.01); *C10M 2217/043* (2013.01); *C10N 2230/36* (2013.01); *C10N 2230/52* (2013.01); *C10N 2240/10* (2013.01)

(58) Field of Classification Search

USPC ..... 508/110, 513

See application file for complete search history.

(56) References Cited

U.S. PATENT DOCUMENTS

| | | | | |
|---|---|---|---|---|
| 3,219,666 | A | 11/1965 | Norman et al. | |
| 3,565,804 | A | 2/1971 | Honnen et al. | |
| 3,697,574 | A | 10/1972 | Piasek et al. | |
| 3,736,357 | A | 5/1973 | Piasek et al. | |
| 3,884,822 | A | 5/1975 | Gemmill, Jr. | |
| 4,152,499 | A * | 5/1979 | Boerzel et al. | 525/381 |
| 4,234,435 | A | 11/1980 | Meinhardt et al. | |
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,272,387 | A | 6/1981 | King et al. | |
| 4,283,295 | A | 8/1981 | deVries et al. | |
| 4,285,822 | A | 8/1981 | deVries et al. | |
| 4,288,335 | A | 9/1981 | Rivier | |
| 4,306,070 | A | 12/1981 | Hammond et al. | |
| 4,426,306 | A * | 1/1984 | Lee et al. | 508/260 |
| 4,636,322 | A | 1/1987 | Nalesnik | |
| 4,702,850 | A | 10/1987 | Gutieirez et al. | |
| 4,847,260 | A * | 7/1989 | Abe et al. | 514/279 |
| 4,867,890 | A | 9/1989 | Coldough et al. | |
| 4,943,672 | A | 7/1990 | Hamner et al. | |
| 5,000,759 | A | 3/1991 | Nalesnik et al. | |
| 5,330,667 | A * | 7/1994 | Tiffany et al. | 508/192 |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,882,505 | A | 3/1999 | Wittenbrink et al. | |
| 5,936,041 | A | 8/1999 | Diana et al. | |
| 5,993,497 | A * | 11/1999 | Cherpeck et al. | 44/347 |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowit et al. | |
| 6,180,575 | B1 | 1/2001 | Nipe | |
| 6,300,291 | B1 | 10/2001 | Harley | |

(Continued)

FOREIGN PATENT DOCUMENTS

| | | |
|---|---|---|
| EP | 1508611 | 2/2005 |
| FR | 2472 M * | 4/1964 |

(Continued)

OTHER PUBLICATIONS

Furst, Hans; Jelesarow, Iwan: "Picolinsaureester hoherer Alknohole und ihre kationaktiven Derivate," Archiv Der Pharmazie, vol. 283, No. 4, (1950), pp. 238-243.

C. Engler: "Zur Kenntnis der Ester und Amide der Pyridincarbonsauren," Berichte Der Deutschen Chemischen Gesellschaft, vol. 27, No. 2, (1894), p. 1784-1789.

(Continued)

*Primary Examiner* — James Goloboy

(74) *Attorney, Agent, or Firm* — Luedeka Neely Group, PC

(57) ABSTRACT

An ashless additive for lubricating oil compositions, lubricating oil compositions and methods for lubricating that are effective to improve the total base number (TBN) of a lubricant composition. The additive is a reaction product of a compound of the formula:

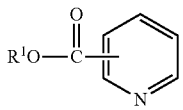

with $NH_3$, an alcohol, an amine, or a hydrocarbyl amine, wherein $R^1$ is selected from H, a hydrocarbyl group, the alcohol or amine contains from 1 to about 24 carbon atoms, and the hydrocarbyl amine has a number average molecular weight ranging from about 100 to about 6000.

7 Claims, No Drawings

(56) References Cited

U.S. PATENT DOCUMENTS

| | | | |
|---|---|---|---|
| 6,548,458 | B2 | 4/2003 | Loper |
| 6,723,685 | B2 | 4/2004 | Hartley et al. |
| 6,858,567 | B2 | 2/2005 | Akao |
| 7,134,381 | B2 | 11/2006 | Ueno et al. |
| 7,405,186 | B2 | 7/2008 | Harrison |
| 7,771,821 | B2 | 8/2010 | Martin |
| 2004/0266630 | A1 | 12/2004 | George et al. |
| 2007/0203031 | A1 | 8/2007 | Bardasz et al. |
| 2012/0040876 | A1 | 2/2012 | Preston et al. |
| 2012/0101012 | A1 | 4/2012 | Delbridge et al. |

FOREIGN PATENT DOCUMENTS

| | | | |
|---|---|---|---|
| GB | 0813524 | | 5/1959 |
| GB | 0972535 | A1 | 10/1964 |
| JP | 10212275 | | 8/1998 |
| WO | WO94/06897 | | 3/1994 |

OTHER PUBLICATIONS

Z. Guo, .D. Dowdy, W. Li, R. Polniaszek, E. Delaney: "A novel method for the mild and selective amidation of diesters and the amidation of monoesters," Tetrahedron Letters, vol. 42, (2001), pp. 1834-1845.

* cited by examiner

LUBRICANT COMPOSITIONS CONTAINING A HETEROAROMATIC COMPOUND

RELATED APPLICATION

This application claims priority to Provisional Application No. 61/488,302, filed May 20, 2011.

TECHNICAL FIELD

The disclosure relates to lubricant compositions and in particular to additives for boosting the total base number (TBN) of a lubricant composition without increasing the ash value of the lubricant.

BACKGROUND AND SUMMARY

Engine lubricant compositions may be selected to provide an increased engine protection while providing reduced emissions. In order to reduce emissions, there is a trend toward lubricant compositions having a reduced ash value. However, in order to achieve benefits of reduced ash value to reduce emissions, a balance between engine protection and lubricating properties is required for the lubricant composition. For example, an increase in the amount of detergent in a lubricant composition may be beneficial for engine protection purposes but may lead to higher ash values. Likewise, an increase in the amount of ashless dispersant may be beneficial to increase engine protection, but may result in poorer seal protection performance. Accordingly, there is a need for improved lubricant compositions that are suitable for meeting or exceeding currently proposed and future lubricant performance standards.

With regard to the foregoing, embodiments of the disclosure provide an ashless additive for lubricating oil compositions, lubricating oil compositions and methods for lubricating that are effective to improve the total base number (TBN) of a lubricant composition. The additive is a reaction product of a compound of the formula:

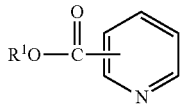

with $NH_3$, an alcohol, an amine, or a hydrocarbyl amine, wherein $R^1$ is selected from H, a hydrocarbyl group. The alcohol or amine contains from 1 to about 24 carbon atoms, and the hydrocarbyl amine has a number average molecular weight ranging from about 100 to about 6000.

A further embodiment of the disclosure provides an engine lubricant composition including base oil and an ashless additive that is a reaction product of a compound of the formula:

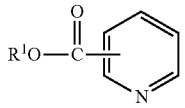

and $NH_3$, an alcohol or an amine or a hydrocarbyl amine, wherein the alcohol or amine contains from 1 to about 24 carbon atoms and wherein the hydrocarbyl amine has a number average molecular weight ranging from about 100 to about 6000. In the formula $R^1$ is H, or a hydrocarbyl group.

Another embodiment of the disclosure provides a method for boosting the total base number (TBN) of a lubricant composition for an engine by from about 1 to about 50 percent over a base value of the TBN of the lubricant composition. The method includes adding to the lubricant composition a minor amount of an ashless additive compound of the formula:

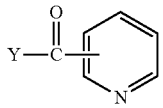

wherein Y is selected from the group consisting of OR and $NR^2R^3$ wherein R is a hydrocarbyl group containing from 1 to about 24 carbon atoms, $R^2$ and $R^3$ are selected from H and a hydrocarbyl group.

In another embodiment there is provided a method for increasing a total base number (TBN) of a lubricant composition while maintaining seal compatibility of the lubricant composition. The method includes boosting the total base number of the lubricant composition by incorporating a minor amount of an ashless additive compound of the formula:

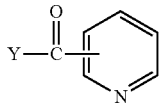

in the lubricant composition, wherein Y is selected from the group consisting of OR and $NR^2R^3$ wherein R is a hydrocarbyl group containing from 1 to about 24 carbon atoms, $R^2$ and $R^3$ are selected from H and a hydrocarbyl group and $R^2$ and $R^3$ may be the same or different. An advantage of the use of an additive composition according to the disclosure is that lubricant formulations containing the additive may exhibit lower sulfated ash content.

A further advantage of the additive composition described herein is that the additive may be effective to boost the TBN of the lubricant formulation with minimal amount of adverse affect on elastomeric seals compared to conventional ashless TBN providing compositions. Conventional methods for increasing the ashless TBN of a lubricant composition may include, but are not limited to, increasing the amount of dispersant in the lubricant composition. Dispersants are typically nitrogen-containing compounds with a polymeric backbone that may be incompatible with or detrimental to elastomeric seals. Further benefits and advantages may be evident from the following disclosure.

The following definitions of terms are provided in order to clarify the meanings of certain terms as used herein.

As used herein, the terms "oil composition," "lubrication composition," "lubricating oil composition," "lubricating oil," "lubricant composition," "lubricating composition," "fully formulated lubricant composition," and "lubricant" are considered synonymous, fully interchangeable terminology referring to the finished lubrication product comprising a major amount of a base oil plus a minor amount of an additive composition.

As used herein, the terms "additive package," "additive concentrate," and "additive composition" are considered synonymous, fully interchangeable terminology referring the portion of the lubricating composition excluding the major amount of base oil stock mixture.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "oil-soluble" or "dispersible" used herein do not necessarily indicate that the compounds or additives are soluble, dissolvable, miscible, or capable of being suspended in the oil in all proportions. The foregoing terms do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Engine lubricating oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil. The fully formulated crankcase lubricant may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EXEMPLARY EMBODIMENTS

The present disclosure will now be described in the more limited aspects of embodiments thereof, including various examples of the formulation and use of the present disclosure. It will be understood that these embodiments are presented solely for the purpose of illustrating the invention and shall not be considered as a limitation upon the scope thereof.

Engine lubricant compositions are used in vehicles containing spark ignition and compression ignition engines. Such engines may be used in automotive and truck applications and may be operated on fuels including, but not limited to, gasoline, diesel, alcohol, compressed natural gas, and the like.

Base Oil

Base oils suitable for use in formulating engine lubricant compositions may be selected from any of suitable mineral oils, synthetic oils, or mixtures thereof. Oils may include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic-naphthenic types. Oils derived from coal or shale may also be suitable. The base oil typically may have a viscosity of about 2 to about 15 cSt or, as a further example, about 2 to about 10 cSt at 100° C. Further, an oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the crankcase lubricant compositions as described herein may be selected from any of the base oils in Groups I-V as specified in the American Petroleum Institute (API) Base Oil Interchangeability Guidelines. Such base oil groups are as follows:

TABLE 1

| Base Oil Group[1] | Sulfur (wt %) | | Saturates (wt %) | Viscosity Index |
|---|---|---|---|---|
| Group I | >0.03 | And/or | <90 | 80 to 120 |
| Group II | ≤0.03 | And | ≥90 | 80 to 120 |
| Group III | ≤0.03 | And | ≥90 | ≥120 |
| Group IV | all polyalphaolefins (PAOs) | | | |
| Group V | all others not included in Groups I-IV | | | |

[1]Groups I-III are mineral oil base stocks.

The, base oil may contain a minor or major amount of a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. Nos. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either mineral oil or synthetic oil (as well as mixtures of two or more of any of these) of the type disclosed hereinabove can be used in the base oils. Unrefined oils are those obtained directly from a mineral oil, vegetable oil, animal oil or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction; filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide a crankcase lubricant composition. Accordingly, the base oil may be present in the crankcase lubricant composition in an amount ranging from about 50 wt % to about 95 wt % based on a total weight of the lubricant composition.

Metal-Containing Detergents

Embodiments of the present disclosure may also comprise at least one metal detergent. Detergents generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from about 0 to less than about 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of about 150 or greater, such as from about 150 to about 450 or more.

Detergents that may be suitable for use in the present embodiments include oil-soluble sulfonates, overbased sulfonates, phenates, sulfurized phenates, salicylates, and carboxylates of a metal, particularly the alkali or alkaline earth metals, e.g., sodium, potassium, lithium, calcium, and magnesium and combinations thereof. More than one metal may be present, for example, both calcium and magnesium. Mixtures of calcium and/or magnesium with sodium may also be suitable. Suitable metal detergents may be overbased calcium or magnesium sulfonates having a TBN of from 100 to 450 TBN, overbased calcium or magnesium phenates or sulfurized phenates having a TBN of from 100 to 450, and overbased calcium or magnesium salicylates having a TBN of from 130 to 350. Mixtures of such salts may also be used.

The metal-containing detergent may be present in a lubricating composition in an amount of from about 0.5 wt % to about 5 wt %. As a further example, the metal-containing detergent may be present in an amount of from about 1.0 wt % to about 3.0 wt %. The metal-containing detergent may be present in a lubricating composition in an amount sufficient to provide from about 500 to about 5000 ppm alkali and/or alkaline earth metal to the lubricant composition based on a total weight of the lubricant composition. As a further example, the metal-containing detergent may be present in a lubricating composition in an amount sufficient to provide from about 1000 to about 3000 ppm alkali and/or alkaline earth metal.

TBN Boosting Additive

In some applications it may be necessary to increase the total base number (TBN) of the lubricant composition in order to better handle deposits and other undesirable components that may increase the acid number of the lubricant composition. Methods for increasing the base number may include, but are not limited to, increasing the amount of dispersant and increasing the amount of detergent. Dispersants are typically basic nitrogen-containing compounds that may be used to increase the TBN of the lubricant composition. However, use of increased amount of conventional dispersants may adversely affect elastomeric (such as fluoroelastomeric) seal compatibility. High levels of dispersants are known to have a deleterious effect on the elastomeric materials conventionally used to form engine seals and, therefore, it is desirable to use the minimum amount of dispersant. Accordingly, the dispersant may provide no greater than 30%, and, as a further example, no greater than 25% of the TBN of the lubricating oil composition.

Accordingly, the bulk TBN of the lubricant composition is typically provided by a detergent. An increase in the amount of detergent in the lubricant composition may undesirably increase the ash content of the lubricant composition above a targeted level. For example, a targeted level may be set by industry standards such as ASTM D4485. However, use of an effective amount of a reaction product of a compound of the formula:

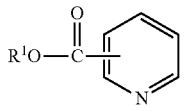

with $NH_3$, an alcohol, an amine, or a hydrocarbyl amine, may be used to increase the TBN of the lubricant composition with minimal adverse affects on elastomeric seals compared to the use of conventional ashless dispersant compositions to obtain a similar TBN increase. In the formula, $R^1$ is selected from H, a hydrocarbyl group. The alcohol or amine may contain from 1 to about 24 carbon atoms, and the hydrocarbyl amine may have a number average molecular weight ranging from about 100 to about 6000.

The reaction product of a compound of the formula:

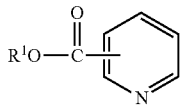

and $NH_3$, an alcohol, an amine, or a hydrocarbyl amine may be conducted by reacting one mole of the foregoing compound with one or more moles of $NH_3$, an alcohol or amine containing from 1 to 24 carbon atoms, or a hydrocarbyl amine having a number average molecular weight ranging from about 100 to about 6000. Suitable alcohols and polyols may include methanol, ethanol, propanol, isopropanol, butanol, isobutanol, pentanol, hexanol, decanol, hexadecanol, glycol, glycerol, hydroxyl esters, such as glycerol fatty esters and tartaric acid esters, propoxylates, fatty amine ethoxylates, and the like containing from 1 to 24 carbon atoms. Suitable amines may include $C_1$ to $C_{24}$ primary or secondary amines and/or polyamines, fatty amine ethoxylates and fatty amine propoxylates.

Hydrocarbyl amines that may be reacted with the foregoing compounds may be selected from hydrocarbyl-substituted amides, hydrocarbyl-substituted imides, hydrocarbyl-substituted succinimides, and hydrocarbyl-substituted imidazolines, hydrocarbyl-substituted Mannich bases, alkoxylated amines, and fatty amines, wherein the hydrocarbyl group has a number average molecular weight ranging from about 100 to about 6000. The reaction of the compound with $NH_3$, an amine, an alcohol, or a hydrocarbyl amine may be conducted at a temperature ranging from about room temperature to about 250° C. The foregoing reactions may also be conducted in an autoclave with pressures ranging from about 1 atmosphere to about 20 atmospheres.

The hydrocarbyl succinimide may be derived from a polyalkenyl or hydrocarbyl-substituted succinic acid or anhydride. The hydrocarbyl-substituted succinic acids or anhydrides may be derived from the reaction of butene polymers, for example polymers of isobutylene with maleic anhydride. Suitable polyisobutenes for use herein include those formed from polyisobutylene or highly reactive polyisobutylene. Highly reactive polyisobtylene means a polyisobutylene having at least about 60%, such as about 70% to about 90% and above, terminal vinylidene content. Suitable polyisobutenes may include those prepared using $BF_3$ catalysts. The average number molecular weight of the polyalkenyl substituent may vary over a wide range, for example from about 100 to about 6000, such as from about 500 to about 3000, as determined by GPC as described above.

In making the hydrocarbyl succinimide, carboxylic reactants other than maleic anhydride may be used such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters. A mole ratio of maleic anhydride to polyalkenyl component in the reaction mixture may vary widely. Accordingly, the mole ratio may vary from about 5:1 to about 1.5, for example from about 3:1 to about 1:3, and as a further example, the maleic anhydride may be used in stoichiometric excess to force the reaction to completion. The anhydride to polyalkenyl component mole ratio in the reaction product may vary from 0.5:1 to greater than 1.5:1. The unreacted maleic anhydride may be removed by vacuum distillation.

In order to make the hydrocarbyl succinimide, the hydrocarbyl-substituted acid or anhydride is further reacted with an amine compound. Any of numerous amines can be used to prepare the polyalkenyl or hydrocarbyl-substituted succinimide, provided the amines are polyamines containing at least two nitrogen atoms. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA), and isomers thereof, and heavy polyamines. A heavy polyamine may comprise a mixture of polyalkylenepolyamines having small amounts of lower polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. A hydrocarbyl imidazoline may be obtained by reacting a carboxylic acid with a polyamine. In an embodiment of the disclosure, the polyamine may be selected from tetraethylene pentamine (TEPA). A particularly suitable hydrocarbyl amine may be a mono-succinimide derived from polyalkenyl succinic anhydride and a polyamine as described above.

In an embodiment, the reaction product may be derived from compounds of formula:

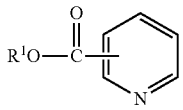

and a hydrocarbyl amine, wherein $R^1$ is defined above. In another embodiment the hydrocarbyl amine may be a compound of the formula:

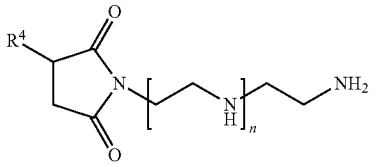

wherein n represents 0 or an integer of from 1 to 5, and $R^4$ is a hydrocarbyl substituent as defined above. In an embodiment, n is 3 and $R^4$ is a polyisobutenyl substituent, such as that derived from polyisobutylenes having at least about 60%, such as about 70% to about 90% and above, terminal vinylidene content. Hydrocarbyl amine compounds of the above formula may be the reaction product of a hydrocarbyl-substituted succinic anhydride, such as a polyisobutenyl succinic anhydride (PIBSA), and a polyamine, for example tetraethylene pentamine (TEPA).

A particularly useful hydrocarbyl amine compound may include an alkenyl-substituted succinic anhydride having a number average molecular weight (Mn) in the range of from about 100 to about 3000 as determined by gel permeation chromatography (GPC) and a polyamine having a general formula $H_2N(CH_2)_m$—$[NH(CH_2)_m]_n$—$NH_2$, wherein m is in the range from 2 to 4 and n is in the range of from 1 to 5.

In another embodiment the reaction product may be derived from compounds of the formula

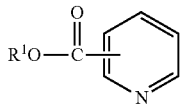

and a hydrocarbyl imidazoline. The hydrocarbyl imidazoline may be a compound of formula

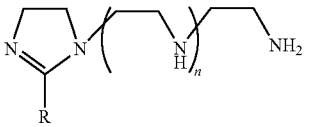

wherein $R^1$ is H or a hydrocarbyl group having 1 to 24 carbon atoms, n represents 0 or an integer of from 1 to 5, and R is a hydrocarbyl substituent as defined above.

The resulting reaction product may be a compound of the formula

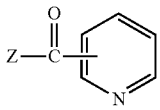

wherein Z is selected from —$NR^2R^3$, wherein $R^2$ and $R^3$ are selected from H and a hydrocarbyl, group wherein $R^2$ and $R^3$ may be the same or different. Amounts of the reaction product used in a lubricant formulation may range from about 0.01 to about 5 wt. % based on a total weight of the lubricant formulation. For example, sufficient amounts of the reaction product may be added to a lubricant composition to increase the TBN of the lubricant composition from about 1 to about 50 percent over a base TBN value of the lubricant composition. Other amounts of the reaction product may be added to a lubricant composition to increase the TBN from about 1 to about 30 percent, or from about 2 to about 25 percent or from about 3 to about 20 percent or from about 5 to about 10 percent over the base TBN value of the lubricant composition. The base TBN value of the lubricant composition is the TBN value of the lubricant composition before adding the reaction product described herein. The reaction product may be added neat to the lubricant composition or may be diluted with diluents such as a process oil to increase the compatibility of the reaction product with a lubricant composition.

Dispersant Components

Dispersants that may be used in an additive package include, but are not limited to, ashless dispersants that have an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729. The dispersants may be further reacted with a variety of acidic materials, such as carboxylic acids and anhydrides, boric acid, metaborates, alkoxy borates, and like.

Phosphorus-Based Antiwear Agents

The phosphorus-based wear preventative may comprise a metal dihydrocarbyl dithiophosphate compound, such as but not limited to a zinc dihydrocarbyl dithiophosphate compound. Suitable metal dihydrocarbyl dithiophosphates may comprise dihydrocarbyl dithiophosphate metal salts wherein the metal may be an alkali or alkaline earth metal, or aluminum, lead, tin, molybdenum, manganese, nickel, copper, or zinc.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The zinc dihydrocarbyl dithiophosphates (ZDDP) are oil soluble salts of dihydrocarbyl dithiophosphoric acids and may be represented by the following formula:

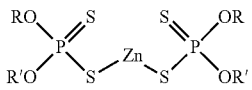

wherein R and R' may be the same or different hydrocarbyl radicals containing from 1 to 18, for example 2 to 12, carbon atoms and including radicals such as alkyl, alkenyl, aryl, arylalkyl, alkaryl, and cycloaliphatic radicals. R and R' groups may be alkyl groups of 2 to 8 carbon atoms. Thus, the radicals may, for example, be ethyl, n-propyl, iso-propyl, n-butyl, iso-butyl, sec-butyl, amyl, n-hexyl, iso-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. The zinc dihydrocarbyl dithiophosphate can therefore comprise zinc dialkyl dithiophosphates.

Other suitable components that may be utilized as the phosphorus-based wear preventative include any suitable organophosphorus compound, such as but not limited to, phosphates, thiophosphates, di-thiophosphates, phosphites, and salts thereof and phosphonates. Suitable examples are tricresyl phosphate (TCP), di-alkyl phosphite (e.g., dibutyl hydrogen phosphite), and amyl acid phosphate.

Another suitable component is a phosphorylated succinimide such as a completed reaction product from a reaction between a hydrocarbyl substituted succinic acylating agent and a polyamine combined with a phosphorus source, such as inorganic or organic phosphorus acid or ester. Further, it may comprise compounds wherein the product may have amide, amidine, and/or salt linkages in addition to the imide linkage of the type that results from the reaction of a primary amino group and an anhydride moiety.

The phosphorus-based wear preventative may be present in a lubricating composition in an amount sufficient to provide from about 200 to about 2000 ppm phosphorus. As a further example, the phosphorus-based wear preventative may be present in a lubricating composition in an amount sufficient to provide from about 500 to about 800 ppm phosphorus.

The phosphorus-based wear preventative may be present in a lubricating composition in an amount sufficient to provide a ratio of alkali and/or alkaline earth metal content (ppm) based on the total amount of alkali and/or alkaline earth metal in the lubricating composition to phosphorus content (ppm) based on the total amount of phosphorus in the lubricating composition of from about 1.6 to about 3.0 (ppm/ppm).

Friction Modifiers

Embodiments of the present disclosure may include one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, and the like.

Suitable friction modifiers may contain hydrocarbyl groups that are selected from straight chain, branched chain, or aromatic hydrocarbyl groups or admixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms and may be saturated or unsaturated.

Aminic friction modifiers may include amides of polyamines. Such compounds can have hydrocarbyl groups that are linear, either saturated or unsaturated, or a mixture thereof and may contain from about 12 to about 25 carbon atoms.

Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference.

Other suitable friction modifiers may include an organic, ashless (metal-free), nitrogen-free organic friction modifier. Such friction modifiers may include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Another example of an organic ashless nitrogen-free friction modifier is known generally as glycerol monooleate (GMO) which may contain mono- and diesters of oleic acid. Other suitable friction modifiers are described in U.S. Pat. No. 6,723,685, herein incorporated by reference. The ashless friction modifier may be present in the lubricant composition in an amount ranging from about 0.1 to about 0.4 percent by weight based on a total weight of the lubricant composition.

Suitable friction modifiers may also include one or more molybdenum compounds. The molybdenum compound may be sulfur-free or sulfur-containing. The molybdenum compound may be selected from the group consisting of molybdenum dithiocarbamates (MoDTC), molybdenum dithiophosphates, molybdenum dithiophosphinates, molybdenum xanthates, molybdenum thioxanthates, molybdenum sulfides, a trinuclear organo-molybdenum compound, molybdenum/amine complexes, and mixtures thereof.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Suitable molybdenum dithiocarbamates may be represented by the formula:

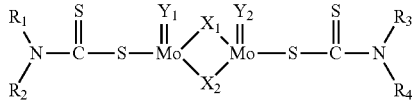

where $R_1$, $R_2$, $R_3$, and $R_4$ each independently represent a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group containing an ester, ether, alcohol, or carboxyl group; and $X_1$, $X_2$, $Y_1$, and $Y_2$ each independently represent a sulfur or oxygen atom.

Examples of suitable groups for each of $R_1$, $R_2$, $R_3$, and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R_1$ to $R_4$ may each have $C_6$ to $C_{18}$ alkyl groups. $X_1$ and $X_2$ may be the same, and $Y_1$ and $Y_2$ may be the same. $X_1$ and $X_2$ may both comprise sulfur atoms, and $Y_1$ and $Y_2$ may both comprise oxygen atoms.

Further examples of molybdenum dithiocarbamates include $C_6$-$C_{18}$ dialkyl or diaryldithiocarbamates, or alkylaryldithiocarbamates such as dibutyl-, diamyl-di-(2-ethylhexyl)-, dilauryl-, dioleyl-, and dicyclohexyl-dithiocarbamate.

Another class of suitable organo-molybdenum compounds are trinuclear molybdenum compounds, such as those of the formula $Mo_3S_kL_nQ_z$ and mixtures thereof, wherein L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference.

The molybdenum compound may be present in a fully formulated engine lubricant in an amount to provide about 5 ppm to 200 ppm molybdenum. As a further example, the molybdenum compound may be present in an amount to provide about 50 to 100 ppm molybdenum.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate may take advantage of the mutual compatibility afforded by the combination of ingredients when in the form of an additive concentrate. Also, the use of a concentrate may reduce blending time and may lessen the possibility of blending errors.

The present disclosure provides novel lubricating oil blends specifically formulated for use as automotive crankcase lubricants. Embodiments of the present disclosure may provide lubricating oils suitable for crankcase applications and having improvements in the following characteristics: antioxidancy, antiwear performance, rust inhibition, fuel economy, water tolerance, air entrainment, and foam reducing properties.

Anti-Foam Agents

In some embodiments, a foam inhibitor may form another component suitable for use in the compositions. Foam inhibitors may be selected from silicones, polyacrylates, and the like. The amount of antifoam agent in the engine lubricant formulations described herein may range from about 0.001 wt % to about 0.1 wt % based on the total weight of the formulation. As a further example, antifoam agent may be present in an amount from about 0.004 wt % to about 0.008 wt %.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and esters thereof, diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylenebis(2,6-di-tert-butylphenol) and mixtures thereof as described in U.S Publication No. 2004/0266630.

Diarylamine antioxidants include, but are not limited to diarylamines having the formula:

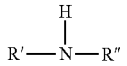

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. In some embodiments, the sulfurized olefin or sulfurized fatty oil may deliver between 200 ppm and 2000 ppm sulfur to the finished lubricant. For example, the sulfurized olefin or sulfurized fatty oil may deliver up to 500 ppm sulfur to the finished lubricant.

The lubricant composition may include other ingredients. One such other ingredient is as oil soluble titanium compounds such as the reaction products of titanium alkoxide and carboxylic acids. In general terms, a suitable engine lubricant may include additive components in the ranges listed in the following table.

TABLE 2

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ash-free phosphorus compound | 0.0-6.0 | 0.0-4.0 |
| Antifoaming agent | 0-5.0 | 0.001-0.15 |
| Supplemental antiwear agents | 0-1.0 | 0-0.8 |
| Pour point depressant | 0.01-5.0 | 0.01-1.5 |
| Viscosity modifier | 0.01-20.00 | 0.25-10.0 |
| Supplemental friction modifier | 0-2.0 | 0.1-1.0 |
| Base oil | Balance | Balance |
| Total | 100 | 100 |

In order to demonstrate the benefits and advantages of lubricant compositions according to the disclosure, the following non-limiting examples are provided.

EXAMPLES

Example 1

Preparation of Butyl Nicotinate Using Sulfuric Acid Catalyst

Nicotinic Acid (3.0 g, 24.4 mmol) and n-butanol (9.0 g, 122 mmol) were mixed together at room temperature in a 2-neck 25 mL round bottom flask equipped with a magnetic stir bar and reflux condenser under an atmosphere of $N_2$. Sulfuric acid (3.59 g, 36.6 mmol) was added dropwise to the flask over a period of 30 min. Once the addition was complete, the reaction mixture was heated to 85° C. and held for 2 hours. The reaction mixture was allowed to cool and poured over ice. The resulting solution was neutralized with $K_2CO_3$ and extracted with EtOAc (2×75 mL). The organic layer was dried over $MgSO_4$, filtered, and concentrated to yield a light yellow liquid. 1H NMR (500 MHz, $CDCl_3$): 9.229 ppm (s), 8.774 ppm (d), 8.305 (d), 7.391 (t), 4.369 (t), 1.762 (m), 1.484 (m), 0.991 (t). IR: 2956.6, 1719.5, 1590.8, and 705.1 $cm^{-1}$.

Example 2

Preparation of Butyl Nicotinate Using Recyclable Alkylbenzene Sulfonic Acid Catalyst Nicotinic Acid (24.6 g, 0.2 mol), n-butanol (100.0 g, 1.33 mol) and heptane (20.1 g) were charged to a 500 mL reaction kettle and equipped with mechanical stir, a Dean-Stark trap, and thermocouple. The mixture was stirred at 300 rpm under nitrogen atmosphere and alkylbenzenesulfonic acid (480 mw, 120 g, 0.25 mol) was added dropwise through an addition funnel over 2 hours. The mixture was heated to 115° C. and held for 3 hours. A second portion of Nicotinic Acid (24.6 g, 0.2 mol) was added through a powder funnel and the temperature was increased to 150° C. and vacuum was applied to −29.5 in Hg and held for 1 hour. The distillate was then taken and solvents removed under vacuum on a rotary evaporator to yield the desired product. This process was repeated 2 additional times using the same Alkylbenzenesulfonic acid.

Example 3

Preparation of Butyl Nicotinate in a Pressure Reactor n-Butanol (177.6 g, 2.4 mol), nicotinic Acid (98.4 g, 0.8 mol) and toluene (45.0 g) were charged to a 450 ml pressure reactor kettle and equipped with mechanical stir, a pressure take-out trap, and a thermocouple. The reactor was sparged with nitrogen and heated to 116° C., sealed, then heated to 200° C. and held for 6 hours. The mixture was then removed from the reaction kettle and volatiles removed under vacuum on a rotary evaporator at 60° C. The product was then purified by combining it with 50.0 g toluene and 60.1 g 4.4% NaOH solution in a 500 mL separatory funnel. The organic layer was then separated, dried over 5 g MgSO4 and solvents removed under vacuum on a rotary evaporator at 60° C. to yield the desired product.

Example 4

Preparation of 2-Ethylhexyl Nicotinate Using Sulfuric Acid Catalyst

Nicotinic acid (3.0 g, 24.4 mmol) and 2-ethylhexanol (15.9 g, 122 mmol) were mixed together at room temperature in a 2-neck 25 mL round bottom flask equipped with a magnetic stir bar and relux condenser under an atmosphere of $N_2$. Sulfuric acid (3.59 g, 36.6 mol) was added dropwise to the flask over a 30 min period. Once the addition was complete, the reaction mixture was heated to 100° C. and held for 4 hours. The reaction mixture was allowed to cool and poured over ice. The resulting solution was neutralized with $K_2CO_3$ and extracted with EtOAc (2×75 mL). The organic layer was dried over $MgSO_4$, filtered, and concentrated to yield a light yellow liquid.

Example 5

Preparation of 2-Ethylhexylnicotinamide

Nicotinic acid (75 g, 0.61 mmoles) and 20 g of xylene were charged to a reactor that is equipped with a sub-surface nitrogen flow, a Dean-Stark trap filled with 20 g of xylene, and a mechanical stirrer. 2-Ethylhexylamine (86.2 g, 0.67 moles) was added to this mixture dropwise. The mixture was heated to up to 210° C. and held until about 9 mL of water collected in the Dean-Stark trap. The mixture was then vacuum stripped to provide a dark residue that contained about 12.1% nitrogen and had infra-red bands at 3300, 1636.7, 1542.1, and 706 $cm^{-1}$.

Example 6

Preparation of 2-EthylHexyl Nicotinate Without Catalyst

2-Ethylhexyl alcohol (215.5 g, 1.65 mol) was charged to a 500 ml resin kettle and equipped with mechanical stir, a Dean-Stark trap and a thermocouple. The mixture was stirred at 300 rpm and nicotinic acid (61.5 g, 0.5 mol) was added in portions through a powder funnel. The mixture was heated to 200° C. with sub-surface nitrogen flow and held for 6 hours. The mixture was then cooled to 150° C. and vacuum was applied to −15 in Hg and held for 45 min. 22.9 g process oil was added and the mixture was then allowed to cool to room temperature under nitrogen atmosphere. The resulting mixture was then filtered twice through Celite Hyflow and Whatman #1 filter paper to yield desired product.

Example 7

Preparation of Oleyl Nicotinamide

Nicotinic acid (75 g, 0.61 mmoles) and 10 mL of xylene were charged to a reactor that is equipped with a sub-surface nitrogen flow, a Dean-Stark trap filled with 25 mL of xylene, and a mechanical stirrer. Oleylamine (163.2 g, 0.61 moles) was added to this mixture dropwise. The mixture was heated to up to 200° C. and held until about 6 mL of water collected in the Dean-Stark trap. The temperature was reduced to about 120° C. and the mixture was then vacuum stripped to provide a dark residue that had a TBN of 168.6 by D2896 method and had infra-red bands at 3300.7, 1626.4, 1545.5, and 707.6 $cm^{-1}$.

Example 8

Reaction of Glycerol Mono-Oleate with Nicotinic Acid

Glycerol mono-oleate (142.2 g, 0.6 mol) and xylenes (50 g) were charged to a 500 ml reaction kettle and equipped with mechanical stir, a Dean-Stark trap and a thermocouple. The mixture was stirred at 300 rpm and nicotinic acid (51.7 g, 0.42 mol) was added in portions through a powder funnel. The mixture was stirred and heated to 200° C. with sub-surface nitrogen and held for 9.5 hours. The mixture was cooled to 130° C. and vacuum was applied to −28.5 in Hg and held for 1 hour. The mixture was then filtered through Celite Hyflow and Whatman #1 filter paper to yield the desired product.

Example 9

Succinimide-nicotinamide

Succinimide (2100 number average molecular weight, 368.8 g, 0.073 mol) and ethyl nicotinate (16.6 g, 0.11 mol) were charged to a 250 mL resin kettle equipped with an overhead stirrer, a Dean-Stark trap and a thermocouple. The reaction mixture was heated under a nitrogen atmosphere to 150° C. for 3 hours. The reaction mixture was diluted with 44.6 g process oil to afford 409.8 g of desired product.

Example 10

Succinimide-nicotinamide

Succinimide (2100 number average molecular weight, 368.8 g, 0.073 mol) and ethyl nicotinate 11.1 g (0.073 mol) were charged to a 250 mL resin kettle equipped with an overhead stirrer, a Dean-Stark trap and a thermocouple. The reaction mixture was heated under a nitrogen atmosphere to 150° C. for 3 hours. The reaction mixture was diluted with 44.6 g process oil to afford 382.3 g of desired product.

Example 11

Succinimide B-nicotinamide

A 500 mL resin kettle equipped with an overhead stirrer, condenser, Dean-Stark trap and a thermocouple was charged with 265.1 g of a 2100 mw PIB succinic anhydride (Acid number 0.41 meq KOH/g) and 15 g (0.079 mol) tetraethylene pentamine. The reaction mixture was heated with stirring under nitrogen at 160° C. for 3 hours. The reaction mixture was diluted with 161.7 g process oil cooled and filtered to afford 404 g of Succinimide B.

Succinimide B (203.6 g, 0.037 mol) and ethyl nicotinate (5.5 g, 0.037 mol) were charged to a 250 mL resin kettle equipped with an overhead stirrer, a condenser, a Dean-Stark trap and a thermocouple. The reaction mixture was heated under a nitrogen atmosphere to 150° C. for 3 hours. The reaction mixture was diluted with 7.7 g process oil to afford 208.8 g of desired product.

Example 12

Succinimide C-nicotinamide

A 500 mL resin kettle equipped with an overhead stirrer, condenser, Dean-Stark trap and a thermocouple was charged under a nitrogen atmosphere with 332.9 g of a 1300 mw PIB succinic anhydride (Acid Number 0.73 meq. KOH/g) and 32.9 g (0.17 mol) tetraethylene pentamine. The reaction mixture was heated with stirring under nitrogen at 160° C. for 3 hours. The reaction mixture was diluted with 244 g process oil cooled and filtered to afford 561 g of Succinimide C.

Succinimide C (127.4 g, 0.037 mol) and ethyl nicotinate (5.5 g, 0.037 mol) were charged to a 250 mL resin kettle equipped with an overhead stirrer, a condenser, a Dean-Stark trap and a thermocouple. The reaction mixture was heated under a nitrogen atmosphere to 150° C. for 3 hours. The reaction mixture was diluted with 7.7 g process oil to afford 111.6 g of desired product.

Example 13

Mannich Base-nicotinamide

A Mannich dispersant (195.3 g, 0.185 mol, reaction product of 950 mw Alkylphenol, formaldehyde and DETA in a ratio of 1:1.1:1) and ethyl nicotinate (27.95 g, 0.185 mol) were charged to a 500 mL resin kettle equipped with an overhead stirrer, a Dean-Stark trap and a thermocouple. The reaction mixture was heated under a nitrogen atmosphere to 120° C. for 3 hours. The reaction mixture was diluted with 235.7 g process oil to afford 502 g of desired product.

Example 14

Dodecylphenol-DETA Mannich-nicotinamide

A Mannich dispersant (75.5 g, 0.2 mol, reaction product of dodecylphenol, formaldehyde and DETA in a ratio of 1:1.1:1) and 30.2 g (0.2 mol) ethyl nicotinate were charged to a 500 mL resin kettle equipped with an overhead stirrer, a Dean-Stark trap and a thermocouple. The reaction mixture was heated under a nitrogen atmosphere to 120° C. for 3 hours. The reaction product was diluted with 96.5 g process oil.

Example 15

Example 16

Preparation of Butyl Nicotinate in a Pressure Reactor without Aqueous Extraction N-butanol (133.2 g, 1.8 mol), nicotinic acid (73.8 g, 0.6 mol) and toluene (45.0 g) were charged to a 450 mL pressure reactor kettle equipped with mechanical stir, a pressure take-out trap, and a thermocouple. The reactor was sparged with nitrogen and heated to 116° C., sealed, then heated to 220° C. and held for 6 hours. The mixture was then removed from the reaction kettle and volatiles removed under vacuum on a rotary evaporator at 60° C. The product was then filtered through celite on a Buchner funnel. 103.4 g product was obtained.

Example 16

An additive composition as listed in Table 3 was top-treated with various TBN boosters, at appropriate treat levels such that the TBN booster increased the TBN, as measured by ASTM D2896 method, by approximately. 1.0 base number. The resulting additive composition was then subjected to an AK-6 seal elastomer compatibility test as outlined by Daimler Fluoroelastomer Seal Compatibility Test VDA 675 301.

TABLE 3

| Component | Wt. % (Broad) |
|---|---|
| $C_9$ alkylated diphenylamine antioxidant | 1.0 |
| Phenolic antioxidant | 1.5 |
| Metal Detergents | 2.5 |
| Zinc dihydrocarbyl dithiophosphate | 1.2 |
| Pour point depressant | 0.1 |
| Viscosity modifier | 9.5 |
| Antifoam agent | 0.01 |
| Base oil | balance |
| Total | 100 |

AK6 rubber was cut into bone shapes with ASTM D1822-61 Type L die cast and placed in 30 ml scintillation vial. About 22 g of blend oil was poured into scintillation vial and the vial was tightly covered with an aluminum foil. The vial was then placed in an oven maintained at 150° C. for 168 hours. The sample was removed from oven, cooled enough to handle and oil was decanted. Excess oil from the rubber bone was blotted with tissues. Seal elongation and tensile strength were then measured using Bluehill INSTRON Model #2519-104. The results are shown in Table 4. Smaller negative values of % Seal Elongation indicated a better result.

TABLE 4

| Ex. No. | TBN booster additive | TBN | % Treat Rate (to deliver about 1.0 TBN) | Treat Ratio Relative to Ex. 1 | % Seal Elongation | Relative seal Compatibility improvement to Ex. 1 | Total Effectiveness |
|---|---|---|---|---|---|---|---|
| | None (baseline) | 7.85 | — | — | −1.0 | — | — |
| 1 | 2100 $M_n$ succinimide dispersant (about 55 wt. % active) (Comparative Example) | 8.60 | 2.44 | 1.0 | −40.5 | 1.0 | 1.0/1.0 = 1.0 |
| 2 | Ethyl Nicotinate | 8.68 | 0.25 | 0.1 | −13.5 | 3.0 | 3.0/0.1 = 30 |
| 3 | Butyl Nicotinate | 8.95 | 0.32 | 0.13 | −9.19 | 4.4 | 4.4/0.13 = 34 |
| 4 | 2-Ethylhexyl Nicotinamide | 9.08 | 0.42 | 0.17 | −25.49 | 1.59 | 1.59/0.17 = 9.3 |
| 5 | Oleyl Nicotinamide | 8.97 | 0.67 | 0.27 | −30.81 | 1.3 | 1.3/0.27 = 4.8 |

As shown by the foregoing examples, ethyl nicotinate required almost one tenth, on a weight basis, of the amount of succinimide dispersant required to deliver about the same TBN, yet ethyl nicotinate was 3 times better in the AK-6 seal compatibility test. Thus, ethyl nicotinate was about 30 (10×3) times more effective than the succinimide dispersant of Example 1.

In the following table, a comparison of Dispersants B and C with the reaction products of Examples 11 and 12 with respect to seal compatibility is shown.

TABLE 5

| | % Treat Rate | % Seal Elongation | Improvement |
|---|---|---|---|
| 2100 mw Dispersant B | 3.4 | −49.1 | — |
| Example 11 | 3.1 | −35.2 | 28% |
| 1300 mw Dispersant C | 1.9 | −44.6 | — |
| Example 12 | 2.0 | −38.7 | 13.2% |

As shown by the examples in the foregoing table, the nicotinamide reaction products of Examples 11 and 12 showed significant improvement in seal compatibility compared to the corresponding succinimide dispersants that were not further reacted with nicotinate.

In the following table, seal compatibility comparisons are shown when using the butyl nicotinate (BN) ashless additive, as generally described in Example 1-3, to top treat and boost the TBN of a fully formulated passenger car motor oil (PCMO) meeting ILSAC GF-5 standards. The fully formulated PCMO contains a typical amount of a mixture of ashless dispersants including a 2100 number average molecular weight (Mn) dispersant made from highly reactive polyisobutylene and a boronated dispersant and a typical dispersant/inhibitor package as set forth in Table 3. The results are shown in the following table compared to the same fully formulated GF-5 formulation having the TBN boosted using an ashless dispersant.

TABLE 6

| Test | PCMO - GF-5 formulated oil | +3.3 wt. % 2100 Mn Dispersant | +0.33 wt. % BN | +6.6 wt. % 2100 Mn Dispersant | +0.66 wt. % BN |
|---|---|---|---|---|---|
| TBN (D2896) | 7.64 | 8.13 | 8.26 | 9.32 | 9.62 |
| Seal Compatibility (ER) | −26 | −55 | −31 | −64 | −36 |
| Seal Compatibility (TS) | −29 | −49 | −31 | −55 | −34 |

As shown by the foregoing results, an amount of the ashless dispersant required to obtain a similar TBN boost from about 0.5 to about 2 TBN over the baseline formulation resulted in significant adverse effects on the seal compatibility of the PCMO lubricant composition. The butyl nicotinate (BN), on the other hand, for similar TBN boost to a lubricant composition has a much lower adverse effect on seal compatibility as compared to the ashless dispersant.

At numerous places throughout this specification, reference has been made to a number of U.S. patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A method for boosting the total base number (TBN) of a lubricant composition for an engine comprising adding to the lubricant composition a minor amount of an ashless additive compound of the formula:

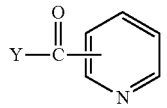

wherein Y is —OR wherein R is a hydrocarbyl group containing from 1 to 8 carbon atoms, whereby the total TBN of the lubricant composition is increased by 1 to 50 percent over a base value of the TBN of the lubricant composition.

2. The method of claim 1, wherein the hydrocarbyl group is selected from the group consisting of methyl, ethyl, butyl, and 2-ethylhexyl groups, and mixtures thereof.

3. The method of claim 1, wherein the minor amount of additive ranges from about 0.01 to about 5.0 weight percent based on a total weight of the lubricant composition.

4. The method of claim 1, wherein the ashless additive compound is effective to boost the TBN of the lubricant composition without increasing an amount of ash-containing detergent in a lubricant composition required to provide the same boosted TBN.

5. A method for improving seal compatibility of a lubricant composition comprising boosting the total base number (TBN) of the lubricant composition by incorporating a minor amount of an ashless additive compound of the formula:

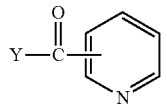

in the lubricant composition, wherein Y is —OR, wherein R is a hydrocarbyl group containing from 1 to 8 carbon atoms, whereby the amount of ashless additive compound incorporated in the lubricant composition is sufficient to increase the TBN of the lubricant composition by from about 1 to about 50 percent over a base value of the TBN of the lubricant composition.

6. The method of claim 5, wherein the hydrocarbyl group is selected from the group consisting of ethyl, butyl, and 2-ethylhexyl groups, and mixtures thereof.

7. The method of claim 5, wherein the minor amount of additive ranges from about 0.01 to about 5.0 weight percent based on a total weight of the lubricant composition.

* * * * *